US005804914A

United States Patent [19]

Ozawa et al.

[11] Patent Number: 5,804,914

[45] Date of Patent: Sep. 8, 1998

[54] FLUORESCENT LAMP HAVING ADDITIONAL AND INTERIOR FLUORESCENT SURFACES TO INCREASE LUMINOSITY

[75] Inventors: Lyuji Ozawa; Kuang-Lung Tsai; Chun-hui Tsai, all of Hsinchu; Chie-Ching Lin, Taichung, all of Taiwan

[73] Assignee: Industrial Technology Research Institute, Hsinchu, Taiwan

[21] Appl. No.: 757,572

[22] Filed: Nov. 27, 1996

[51] Int. Cl.[6] ..... H01J 1/62; H01J 63/04

[52] U.S. Cl. ..... 313/493; 313/485

[58] Field of Search ..... 313/485, 493, 313/573, 577, 634, 635

[56] References Cited

U.S. PATENT DOCUMENTS

| | | | |
|---|---|---|---|
| 3,194,997 | 7/1965 | Waly | 313/493 |
| 4,260,931 | 4/1981 | Wesselink et al. | 313/493 |
| 4,617,489 | 10/1986 | Hough | 313/493 |
| 4,740,729 | 4/1988 | Chow | 313/493 |
| 5,648,700 | 7/1997 | Chu et al. | 313/493 |

*Primary Examiner*—William L. Oen

*Attorney, Agent, or Firm*—Beveridge, DeGrandi, Weilacher & Young, LLP

[57] ABSTRACT

A fluorescent lamp with multiple fluorescent surfaces including a hollow outer tube of any desirable shape, and at least one transparent inner tube or plate-like structure of any shape disposed inside the outer tube. The filaments are mounted at each end of the outer tube. The outer tube is filled with mercury vapor when it is in a vacuum state (less than $10^{-3}$ torr). The inner and outer wall surfaces of the inner tube or plate-like structure and the inner wall surface of the outer tube are all coated with fluorescent materials. When the filaments are supplied with electric currents to release electrons which collide with the mercury molecules to generate ultra-violet rays, much more fluorescent materials will be reached by the ultra-violet rays to generate visible light, thus increasing the luminosity of the fluorescent lamp. A method of manufacturing the fluorescent lamp is also disclosed.

16 Claims, 2 Drawing Sheets

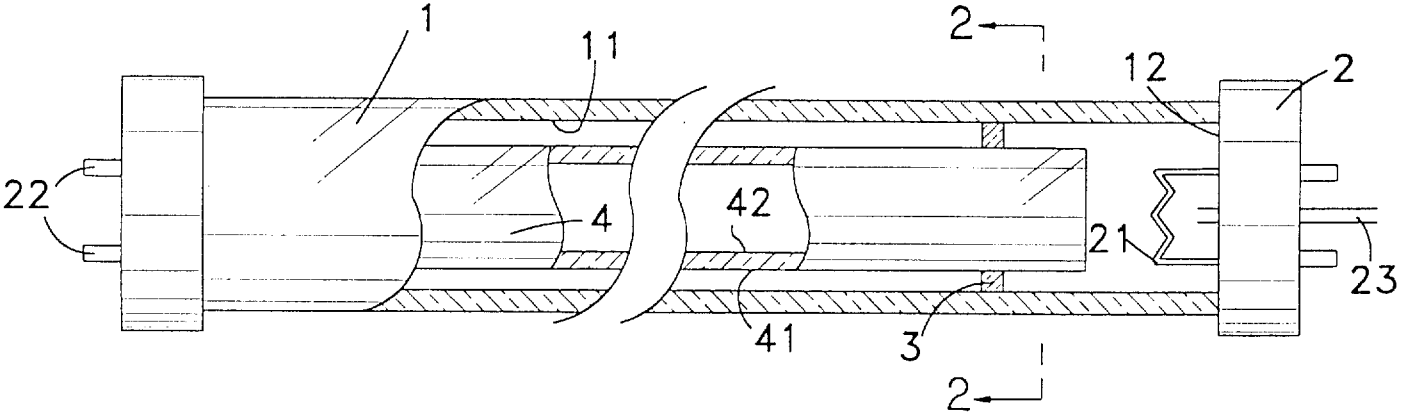
FIG. 1
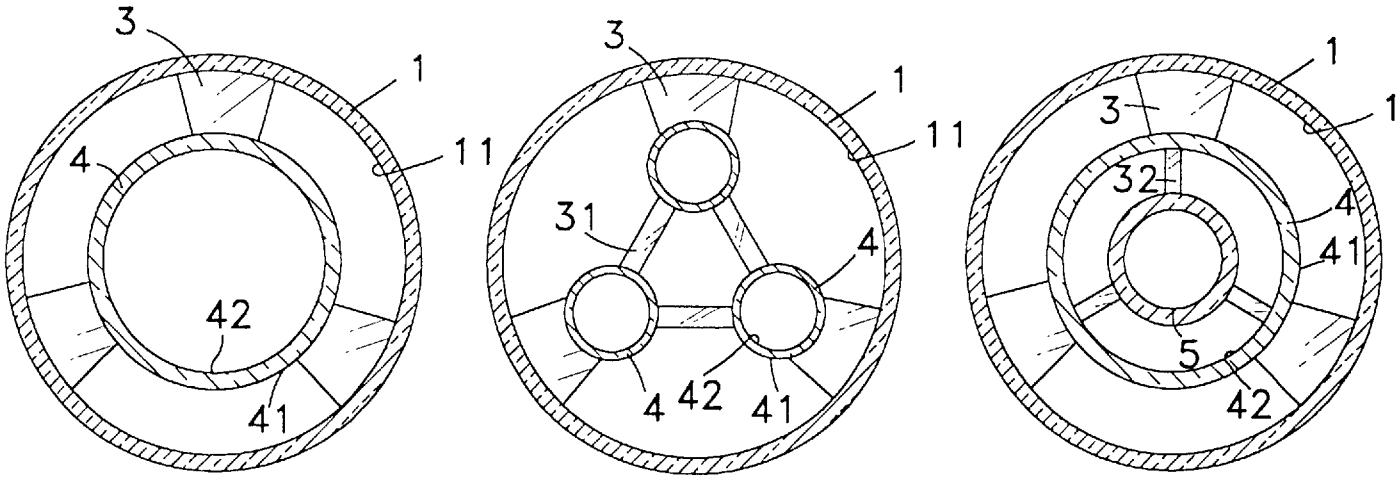
FIG. 2
FIG. 3
FIG. 4

FLUORESCENT LAMP HAVING ADDITIONAL AND INTERIOR FLUORESCENT SURFACES TO INCREASE LUMINOSITY

BACKGROUND OF THE INVENTION

1. Field of the Invention

The present invention relates generally to a fluorescent lamp, and more particularly to a fluorescent lamp structure with multiple fluorescent surfaces and a method of manufacturing the same.

2. Description of the Prior Art

A conventional fluorescent lamp essentially comprises a hollow glass tube with an inner wall coated with a layer of luminous material (generally a fluorescent or phosphorescent metallic salt), the tube being vacuumed to reduce its internal pressure before it is filled with mercury vapor, i.e., a mixture of noble gas and a small dose of mercury. The ends of the tube are each provided with a filament. When electric currents flow through the filaments, heat electrons are released and collide with mercury molecules in the tube with the acceleration of the electric field to form plasma and generate invisible ultra-violet rays. When the ultra-violet rays reach the fluorescent powder in the tube, visible light of a relatively longer wavelength will be generated.

When plasma is generated by the fluorescent lamp, only the ultra-violet rays near the inner wall of the tube may reach the fluorescent material to generate visible light. Those that are near the inner central area of the tube are mostly absorbed by the plasma as heat energy and cannot be turned to good use. Such a phenomenon has existed since the invention of fluorescent lamps, but there has not been provided a solution to solve the long-felt problem that most ultra-violet rays cannot be utilized for the excitation of the fluorescent material to generate visible light.

SUMMARY OF THE INVENTION

Accordingly, a primary object of the present invention is to provide a fluorescent lamp with multiple fluorescent surfaces to fully utilize the ultra-violet rays generated by the fluorescent lamp.

Another object of the present invention is to provide a fluorescent lamp which may have increased luminosity.

A further object of the present invention is to provide a fluorescent lamp which may generate lights of different colors.

Still another object of the present invention is to provide a method of manufacturing a fluorescent lamp with multiple fluorescent surfaces.

In order to achieve the above-mentioned objects, the present invention essentially comprises a hollow outer tube of any desirable shape and at least one transparent inner tube or plate-like structure disposed within the outer tube. The filaments are provided at the ends of the outer tube. Air inside the outer tube is pumped out until the outer tube is in a vacuum state (less than $10^{-3}$ torr). The outer tube is then filled with mercury vapor. The inner wall surface and outer wall surface of the inner tube or plate-like structure as well the inner wall surface of the outer tube are coated with fluorescent materials, so that when the filaments are supplied with electric currents to release electrons which collide with the mercury molecules to generate ultra-violet rays, more fluorescent materials may be reached by the ultraviolet rays to generate visible light, thus increasing the luminosity of the lamp.

In a method of manufacturing the fluorescent lamp of the invention, a transparent inner tube or plate-like structure is fixed inside an outer tube before caps are used to seal the ends of the outer tube which are each provided with a filament. Fluorescent powder of different colors may be used to coat the inner tube so that the fluorescent lamp may generate lights of different colors.

BRIEF DESCRIPTION OF THE DRAWINGS

The foregoing and other features and advantages of the present invention will be more clearly understood from the following detailed description and the accompanying drawings, in which, FIG. 1 is a front view of a preferred embodiment of the present invention with a partial section illustrating the interior structure of the fluorescent lamp;

FIG. 2 is a sectional view taken along line A—A of FIG. 1;

FIG. 3 is similar to FIG. 2, but showing a second preferred embodiment;

FIG. 4 is similar to FIG. 2, but showing a third preferred embodiment.

DETAILED DESCRIPTION OF THE PREFERRED EMBODIMENTS

Figure 5:
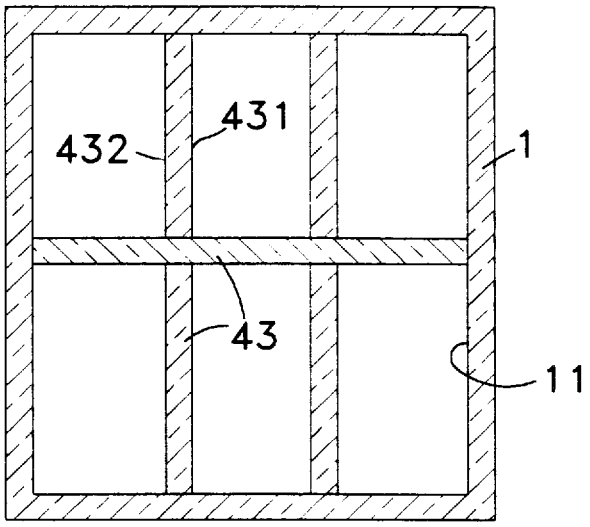
FIG. 5 is similar to FIG. 2, but showing a fourth preferred embodiment.

An embodiment of the fluorescent lamp according to the present invention is shown in FIGS. 1–2 and has multiple fluorescent surfaces. The fluorescent lamp of the invention essentially comprises a transparent or translucent hollow outer glass tube 1 with an opening at each end, and an inner wall surface 11 of its wall is coated with a fluorescent or phosphorescent material. The ends of the outer tube 1 are each sealed by a cap 2. The inner side of the cap 2 is provided with a filament 21 connected to a couple of connecting pins 22 of a power source at the outer side. The cap 2 at one side is further provided with an air extracting tube 23 connected to the outer side. By means of the air extracting tube 23, air inside the outer tube 1 is extracted during the process of production until the interior of the outer tube 1 is in a vacuum state. The outer tube 1 is then filled with mercury vapor. A hollow inner glass tube 4 having an opening at each end is disposed inside the outer tube 1. The inner tube 4 is coated with fluorescent powder on both its outer wall surface 41 and its inner wall surface 42 and has a diameter smaller than that of the outer tube 1. The inner tube 4 is secured inside the outer tube 1 by means of a support means 3. The support means 3 may have any size. Preferably it may support the inner tube 4 from three positions as shown in FIG. 2. Certainly, the ends of the inner tube 4 should be supported by the support means 3. As for the ways of supporting the inner tube 4 within the outer tube 1, a vitreous bonding agent may be used. Alternatively, glass may be sintered at 400° C.–500° C. and disposed between the inner tube 4 and the outer tube 1 to form the above-mentioned support means 3. At least the outer wall surface 41 or the inner wall surface 42 of the inner tube 4 is coated with fluorescent powder. Preferably, both the the outer and the inner wall surfaces 41, 42 are coated with fluorescent powder so that all the ultra-violet rays generated after the outer tube 1 is electrically connected may be fully utilized to excite the fluorescent powder to increase the luminosity of the lamp.

Another preferred embodiment is shown in FIG. 3. A plurality of inner tubes 4 are disposed inside the outer tube 1. The inner tubes 4 are isolated from each other by means of a partition piece 31 and are each secured by the support means 3 in the outer tube 1. Preferably, as shown in FIG. 3, there are three inner tubes 4 arranged in a triangular pattern and distributed inside the outer tube 1. The partition pieces 31 are preferably transparent or translucent thin pieces coated with fluorescent powder to prevent formation of any dark zones in the lamp.

Still another preferred embodiment is shown in FIG. 4. In this embodiment, the inner tube is a multi-layered one. In other words, a first inner tube 4 contains a second inner tube 5 which is secured in as well as separated from the first inner tube 4 by means of a plurality of partition pieces 32. The second inner tube 5 is identical to the first inner tube 4 in structure, except that its diameter is smaller. The second tube 5 is preferably concentric with the first inner tube 4 and secured therein. Obviously, the second inner tube 5 may also contain an inner tube of a still smaller diameter, but such will not be described in detail herein.

Certainly, it should be noted that the support means 3 should not block the flow of electrons in the outer tube 1. Therefore, viewed from FIGS. 2 and 3, the sectional area of the support means 3 should be as small as possible.

The outer tube 1 of the invention may have any shapes, such as circular, triangular, square, elliptical, etc. As for the inner tube 4, it may be a circular one as shown in FIGS. 2–4. Or it does not have to be a tubular structure at all. In other words, plate-like structures of any shapes may suffice. In the embodiment shown in FIG. 5, a plurality of transparent planar plates 43 are secured in a criss-cross pattern within the outer tube 1 to constitute the above-mentioned inner tubes. Besides, each plate 43 has both sides 431 and 432 coated with fluorescent powder to enhance the luminosity of the lamp. In this embodiment, support means or partition pieces may be dispensed with. But since modifications as such fall within the scope of the appending claims, they will not be described in detail herein.

For a lamp comprising an outer tube accommodating multiple inner tubes or plate-like structures, each inner tube (or plate-like structure) may be coated with fluorescent powder of different base material, so that the color of the light emitted by the lamp may have more variety.

According to a method of making the fluorescent lamp of the present invention, a transparent hollow tube having an opening at each end is pre-formed to serve as the outer tube. The outer tube is then coated with a layer of luminous material at its inner wall surface. Then one or more transparent hollow tubes of a smaller diameter than that of the outer tube is/are formed and coated with a layer of luminous material at its/their inner or outer wall surface(s). Obviously, both the inner and the outer surfaces are each coated with a layer of luminous material. Next, the inner tube or tubes thus formed has/have to be disposed inside the outer tube. At this step, the inner tube or tubes may be secured in the outer tube by means of the above-described support means. A filament is then installed at each end of the outer tube and a cap with a couple of electric connecting pins on the outer side is fitted to each end of the outer tube for sealing purposes. Generally speaking, the cap at one end is provided with an air extracting element for pumping out the air inside the outer tube to create a vacuum therein for the subsequent filling in of mercury vapor. Thereafter, the air extracting element is sealed.

The above-described steps of the method do not have any specific order. It however requires that the inner tube or tubes be secured inside the outer tube before the sealing of the ends of the outer tube and that air pumping is done after the ends are sealed.

In the fluorescent lamp of the present invention, since not only the inner wall surface of the outer tube but the inner tube is also coated with fluorescent material, the ultra-violet rays at the central area of the fluorescent lamp may be fully utilized to excite the fluorescent material. Besides, it can be seen that the total surface area of the inner tube is more than twice as great as the inner surface area of the outer tube. In other words, the total luminous area of the inner tube is more than twice as great as that of the outer tube. Therefore, the luminosity provided by a 20-Watt fluorescent lamp according to the present invention is greater than that provided by a 40-Watt fluorescent lamp of the prior art. The present invention provides an effective and economical use of energy and is hence a breakthrough in the art.

Although the present invention has been illustrated and described with reference to the preferred embodiments thereof, it should be understood that it is in no way limited to the details of such embodiments, but is capable of numerous modifications within the scope of the appended claims.

What is claimed is:

1. A fluorescent lamp with multiple fluorescent surfaces, comprising:

a hollow outer tube having an opening defined at each end and an inner wall surface coated with a layer of fluorescent material, said each end being sealed by a cap, an inner side of said cap being provided with a filament connected to a couple of electric power connecting pins at an outer side of said cap, said outer tube having an interior in a vacuum and low pressure state, said interior being filled with mercury vapor; and a hollow inner tube having openings defined at each end and being secured by a supporting means within said outer tube, at least an inner wall surface of said inner tube being coated with a layer of fluorescent material, wherein ultra-violet rays generated in said outer tube excite the layers of fluorescent material coated on said inner and outer tubes, thereby increasing the luminosity of the fluorescent lamp.

2. A fluorescent lamp as claimed in claim 1, wherein said inner wall surface and an outer wall surface of said inner tube are respectively coated with a layer of fluorescent material.

3. A fluorescent lamp as claimed in claim 1, wherein:

said outer tube and said inner tube are at least translucent.

4. A fluorescent lamp with multiple fluorescent surfaces, comprising:

a hollow outer tube having an opening defined at each end and an inner wall surface coated with a layer of fluorescent material, said each end being sealed by a cap, an inner side of said cap being provided with a filament connected to a couple of electric power connecting pins at an outer side of said cap, said outer tube having an interior in a vacuum and low pressure state, said interior being filled with mercury vapor; and a plurality of hollow inner tubes each defining open ends and being respectively disposed and secured inside said outer tube, said inner tubes being isolated from each other by a plurality of partition pieces, each of said inner tubes being coated with a layer of fluorescent material on at least an inner wall surface thereof, wherein ultra violet rays generated in said outer tube excite the layers of fluorescent material on each of said inner tubes and on said outer tubes, thereby increasing the luminosity of the fluorescent lamp.

5. A fluorescent lamp as claimed in claim 4, wherein each of said inner tubes is coated with a fluorescent material of a different base material.

6. A fluorescent lamp as claimed in claim 4, wherein said inner tubes are three in number and are arranged in a triangular pattern inside said outer tube.

7. A fluorescent lamp as claimed in claim 4, wherein said inner wall surface and an outer wall surface of each of said inner tubes is coated with a layer of fluorescent material.

8. A fluorescent lamp as claimed in claim 4, wherein said partition pieces each are a thin piece coated with fluorescent material.

9. A fluorescent lamp as claimed in claim 4, wherein:

said outer tube and said inner tube are at least translucent.

10. A fluorescent lamp with multiple fluorescent surfaces, comprising:

a hollow outer tube having an opening defined at each end and an inner wall surface coated with a layer of fluorescent material, said each end being sealed by a cap, an inner side of said cap being provided with a filament connected to a couple of electric power connecting pins at an outer side of said cap, said outer tube having an interior in a vacuum and low pressure state, said interior being filled with mercury vapor; and a plurality of hollow inner tubes of different diameters each defining open ends, said inner tubes being separated from each other by a plurality of supports such that a multi-ringed structure is formed and secured within said outer tube, each of said inner tubes being coated with a layer of fluorescent material on at least an inner wall surface thereof, wherein ultra-violet rays generated in said outer tube excite the layers of fluorescent material on each of said inner tubes and on said outer tube, thereby increasing the luminosity of the fluorescent lamp.

11. A fluorescent lamp as claimed in claim 10, wherein said inner tubes are each coated with a fluorescent material of a different base material.

12. A fluorescent lamp as claimed in claim 10, wherein said inner wall surface and an outer wall surface of each of said inner tubes are coated with a layer of fluorescent material.

13. A fluorescent lamp as claimed in claim 10, wherein:

said plurality of inner tubes are concentrically disposed to form said multi-ringed member.

14. A fluorescent lamp as claimed in claim 10, wherein:

said outer tube and said inner tube are at least translucent.

15. A fluorescent lamp with multiple fluorescent surfaces, comprising:

a hollow outer tube having an opening defined at each end and an inner wall surface coated with a layer of fluorescent material, said each end being sealed by a cap, an inner side of said cap being provided with a filament connected to a couple of electric power connecting pins at an outer side of said cap, said outer tube having an interior in a vacuum and low pressure state, said interior being filled with mercury vapor; and at least one plate having two sides coated with a layer of fluorescent material, said plate being disposed and secured inside said outer tube such that ultra-violet rays generated in said outer tube excite the fluorescent material on said plate and on said outer tube, thereby increasing the luminosity of the fluorescent lamp.

16. A fluorescent lamp as claimed in claim 15, wherein:

said outer tube and said inner tube are at least translucent.

* * * * *